US005381956A

United States Patent [19]

Robinson et al.

[11] Patent Number: 5,381,956

[45] Date of Patent: Jan. 17, 1995

[54] SELF ACTIVATING FALLING WATER DISPLAY

[75] Inventors: Alan S. Robinson, El Monte; Joseph W. Starr, Burbank, both of Calif.

[73] Assignee: Wet Design, Universal City, Calif.

[21] Appl. No.: 112,429

[22] Filed: Aug. 26, 1993

[51] Int. Cl.[6] ..... B05B 17/08

[52] U.S. Cl. ..... 239/22; 239/17; 137/132; 137/397

[58] Field of Search ..... 239/16–18, 239/20, 22, 23; 137/132, 138, 397

[56] References Cited

U.S. PATENT DOCUMENTS

| | | | |
|---|---|---|---|
| 143,456 | 10/1873 | Moore | 239/17 |
| 2,589,068 | 3/1952 | Evans, Jr. | 137/132 |
| 2,756,766 | 7/1956 | Tronic | 137/397 |
| 3,930,334 | 1/1976 | Johnston | 239/17 |
| 4,149,674 | 4/1979 | Fukamizu et al. | 239/20 |
| 4,291,836 | 9/1981 | Chen-Hsiung | 137/397 |
| 4,938,420 | 7/1990 | Ruttenberg | 137/132 |

*Primary Examiner*—Karen B. Merritt
*Attorney, Agent, or Firm*—Blakely, Sokoloff, Taylor & Zafman

[57] ABSTRACT

A water display that has a container with a floor that defines an inner cavity. The container has a top opening adapted to allow a fluid to flow into the inner cavity at a first predetermined flowrate. The floor is constructed to contain the fluid when the fluid flows into the inner cavity, such that the fluid reaches a first predetermined level within the container. The floor also has a floor opening adapted to allow the fluid to flow out of the inner cavity. Within the container is a valve operatively connected to the floor opening that allows the fluid to flow out of the inner cavity at a second predetermined flowrate, when the fluid level reaches the first predetermined level. The second flowrate being greater than the first flowrate, such that when the valve allows the fluid to flow out of the container, the fluid level in the inner cavity decreases until the fluid level reaches a second predetermined level.

35 Claims, 4 Drawing Sheets

SELF ACTIVATING FALLING WATER DISPLAY

BACKGROUND OF THE INVENTION

Large public buildings typically have a chandelier or other ornamental device to compliment the appearance of the building. Water displays such as water fountains and the like, are particularly attractive because of the soothing sound of running water and the addition of a natural element in an otherwise man made surrounding. Water displays with various flow patterns have been widely used. It being particularly desirable to have a formation that does not typically occur in nature to catch the viewer's eye. Most exotic water displays utilize a sophisticated series of nozzles, valves and pumps to obtain the desired flow pattern. Pumps and valves are expensive and susceptible to failure, it would therefore be desirable to create a water display that induces fluid flow with the simple force of gravity.

SUMMARY OF THE INVENTION

The present invention is a water display that has a container that is filled with a fluid, and a valve that allows the fluid to flow out of the container when the fluid reaches a predetermined level within the container. In one embodiment, the valve has a tube centrally located within a cup shaped housing. The tube has a first end that creates an opening in a floor of the container. The floor defines an inner cavity within the container. The container floor traps the fluid as the fluid flows into the inner cavity from the top of the container. The first tube has a second opening located in the container at approximately the predetermined level. The second tube has an opening near the container floor. The coaxial tubes define an annular passage that allows fluid communication between the second tube opening and the second opening of the first tube. As the fluid fills the container cavity, the fluid level rises in both the inner cavity and the annular passage until the fluid reaches the second opening of the first tube. The fluid then flows down the first tube and out of the container. The container is typically suspended from a ceiling, wherein the fluid falls to a pool below. The flowrate of the fluid out of the first tube is greater than the flowrate into the inner cavity, such that the fluid level within the container decreases while the fluid flows out of the first tube. The flow of the fluid through the first tube creates a siphon, wherein the fluid flows through the tubes even when the level is below the second opening of the first tube. The siphoning continues until the fluid level drops below the opening of the second tube. The inner cavity is again filled and the cycle is repeated.

As an alternate valve embodiment, the container floor can have an opening that is closed by a first float. The float is attached to a tube constructed to slide along a rod that extends from the top to the bottom of the container. Attached to the tube is a magnet that is magnetically attached by a predetermined force to another magnet located a predetermined distance from the floor. The magnets keep the first float in a closed position preventing fluid from flowing through the opening. A second float is attached to the tube such that it can move relative to the tube in a vertical direction. When fluid is introduced into the container cavity, the fluid level within the cavity rises causing the second float to move upward away from the first float. The second float continues to rise until it abuts against a flat collar attached to the tube a predetermined distance from the container floor. The fluid level continues to rise until the buoyancy force of the second float is greater than the magnetic force between the magnets, at which point the magnets are separated and the second float is allowed to float to a static position within the fluid. The movement of the second float moves the collar, tube and the first float such that the first float is no longer obstructing the opening. The flow of fluid out of the container is again greater than the flowrate into the container such that the fluid level in the inner cavity decreases. As the water level decreases the first float moves the tube downward until the magnets come within operative contact of each other, wherein the magnets attract forcing the first float to seat into the opening again preventing fluid flow.

Screens can be located at the bottom of the container such that the fluid flows down to the pool in various arrangements and formations. Thus what is provided is a device that can be easily connected to a municipal water supply, that will create an exotic water display that can be located on the ceiling of a building. The display produces a cycled flow of water without any pumps, timers or control valves which are both expensive and susceptible to failure.

BRIEF DESCRIPTION OF THE DRAWINGS

The objects and advantages of the present invention will become more readily apparent to those skilled in the art after reviewing the following detailed description and the accompanying drawings, wherein.

DETAILED DESCRIPTION OF THE INVENTION

Figure 1:
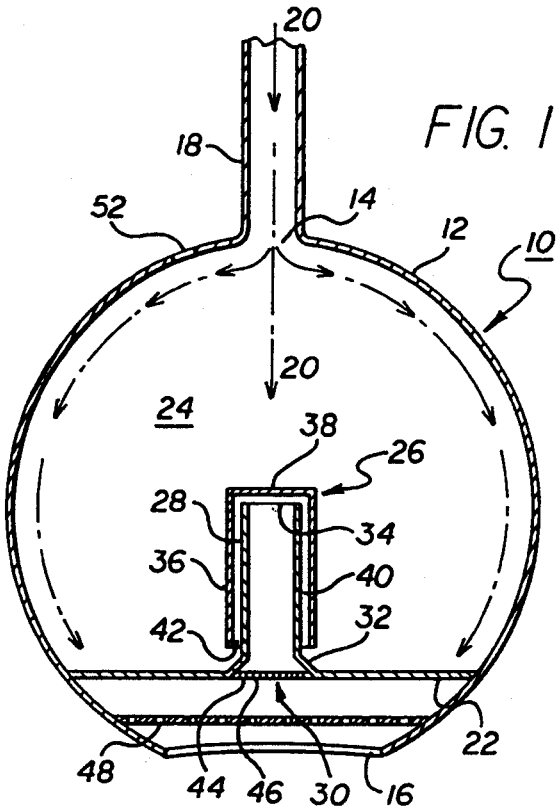
FIG. 1 is a side view of a water display of the present invention showing a siphon valve within a container.

Referring to the drawings more particularly by reference numbers, FIG. 1 shows a liquid ornamental display 10 of the present invention. The display 10 has a container 12 that has a top opening 14 and a bottom opening 16. The container 12 can be of any shape and is preferably constructed from a transparent material such as glass which can also be tinted a predetermined color. FIG. 1 shows a side sectional view of a spherical shaped body that is essentially a glass bulb blown and assembled into the desired shape. The container 12 may have a light source outside or within the container to illuminate the container. Typically the container 12 is suspended from a structure (not shown), so that people can easily view the display 10. FIG. 1 shows the container 12 having a stem 18 with the top opening 14 incorporated therein. The container opening 14 allows a fluid 20 to flow into the container 12. The fluid 20 is preferably water, but it can be any liquid with various colors and viscosities. Typically the flowrate of the fluid flowing into the display 10 is low enough so that some of the fluid 20 flows along the container 12 as indicated by the arrows in FIG. 1. Within the container 12 is a floor 22 that forms an inner cavity 24. Mounted on the floor 22 is a siphon valve 26. The siphon valve 26 comprises a first tube 28 with a first opening 30 in the floor 22. The first tube 28 can have a flared portion 32 at the first opening 30 to disperse the flow of fluid over a greater area. The first tube 28 has a second opening 34 at a predetermined distance from the floor 22. The first tube 28 is enclosed by a cup shaped housing 36, that has a top surface 38 that prevents fluid 20 from flowing directly from the top opening 14 or the inner cavity 24 into the second opening 34. The housing 36 is spaced from the first tube such that the members define an annular passage 40. The passage 40 has a third opening 42 that allows the fluid 20 to flow from the inner cavity 24, through the passage 40 and into the first tube 28. The tube 28 and housing 36 can be be formed into any shape and constructed from transparent, tinted or opaque material. For example the valve 26 and fluid may both be black, such that there is not a clear definition between the tubes and the fluid. The housing 36 may be suspended from the top of the container 12, spaced from the floor 22, or attached directly to the first tube 28 along the third opening 42, wherein there is a plurality of holes that define the third opening 42. Although a separate housing 36 and tube 28 is described and shown, it is to be understood that the openings and passage could be formed from one tube member bent into the configuration shown. A first screen 44 with a plurality of slits or openings 46 can be attached to the first opening 30 to diffuse the fluid 20 as it flows out of the first tube 28. The container 12 can also have a second screen 48 below the first screen 44. The second screen 48 may also have a plurality of slits or openings 50 that diffuse the fluid 20 as it flows through the screen 48.

Figure 2:
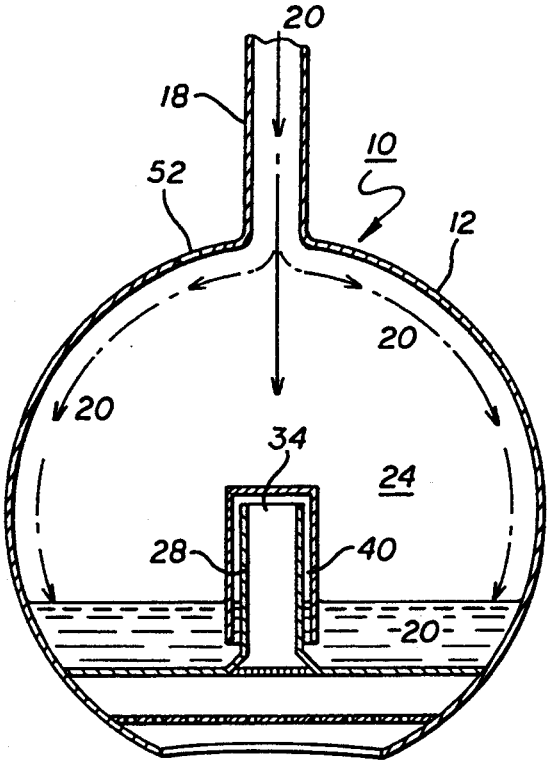
FIG. 2 is a side view of the water display of FIG. 1 showing fluid filling the container.
Figure 3:
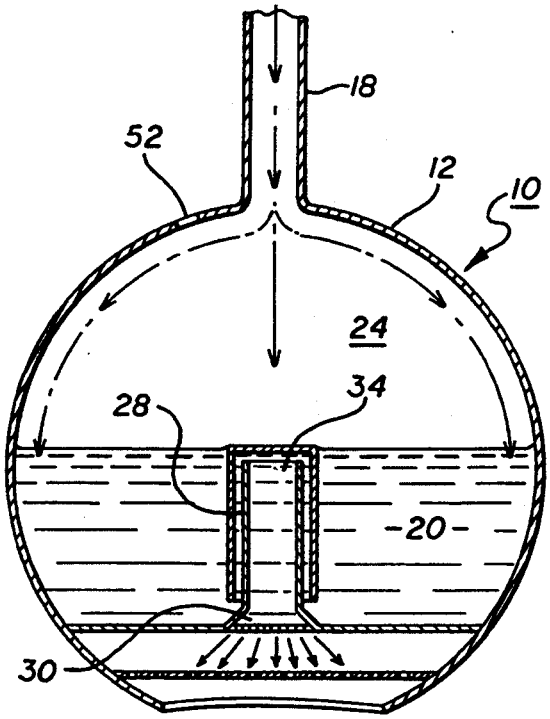
FIG. 3 is a side view of the water display of FIG. 1 showing the fluid reaching a predetermined level, wherein the fluid flows out of the siphon valve.
Figure 4:
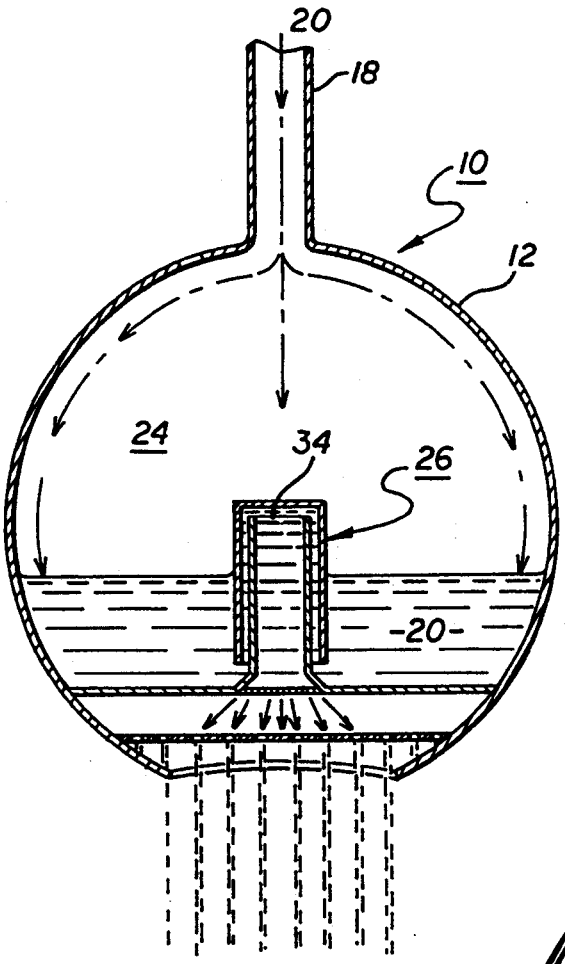
FIG. 4 is a side view of the water display of FIG. 1 showing the siphon valve continuing to draw fluid from the container cavity.
Figure 5:
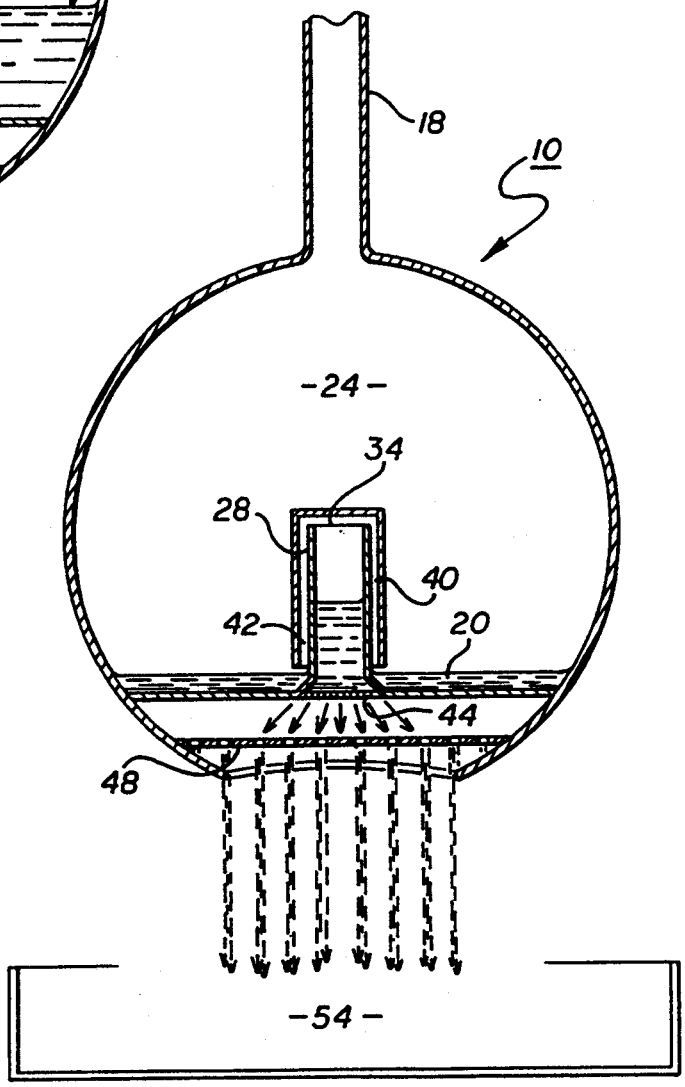
FIG. 5 is a side view of the water display of FIG. 1 showing the fluid level below the opening of the siphon valve, wherein the siphon valve no longer continues to draw fluid out of the container cavity.

FIGS. 2–5 show the operation of the liquid display 10, wherein the fluid 20 flows into the inner cavity 24. The fluid 20 can come from a source that provides the fluid at a constant first flowrate, if the fluid 20 is water the source may be a municipal water line. The display 10 may have a valve to control and vary the flow of the fluid 20 into the container 12. FIG. 2 shows the fluid level within the inner cavity 24 rising while fluid 20 flows into the container 12. As can be seen, the fluid 20 also flows into the annular passage 40. The fluid level continues to rise until the fluid 20 within the passage 40 reaches the second opening 34, at which point the fluid 20 flows down the first tube 28 and out the first opening 30 as shown in FIG. 3. The first tube 28 is constructed in such dimensions that the flowrate of the fluid 20 out of the first opening 30 is greater than the flowrate of the fluid 20 into the container 12. Thus the level of the fluid 20 decreases while the fluid 20 is flowing out of the container 12. The flow of the fluid 20 down the first tube 28 induces a vacuum within the first tube 28, such that the fluid pressure at the second opening 34 is less than the air pressure within the inner cavity 24. To insure that a vacuum is not drawn in the inner cavity 24, a vent 52 can be incorporated into the container 12, to allow air to flow into the inner cavity 24 from the ambient, such that the air pressure within the inner cavity 24 is atmospheric at all times. The differential pressure between the inner cavity 24 and second opening 34 causes the fluid 20 to continue to flow through the siphon valve 26, even when the fluid level in the inner cavity 24 is below the second opening 34 as shown in FIG. 4. As shown in FIG. 5 the fluid 20 continues to be siphoned until the fluid level goes below the third opening 42, at which point air flows into the passage 40 such that the pressure between the inner cavity 24 and second opening 34 are equal. The fluid level rises again repeating the cycle as long as fluid 20 flows into the container 12. FIG. 5 also shows the screens 44 and 48, collect and collimate the fluid 20 as it flows from the first tube 28 out of the container 12. Although one siphon valve is shown, two or more valves could be used. In addition, an ink tank could be added to the siphon valves 26 to introduce color to the fluid 20 as it flows through the valve 26. If the container 12 is suspended from a structure, a pool 54 may be placed below the bottom of the container 12, such that the fluid 20 can be collected and reused. The display 10 can be constructed so that a container 12 is placed below another container 12, such that the fluid 20 falls into an adjacent container which would have a delayed siphoning cycle.

Figure 6:
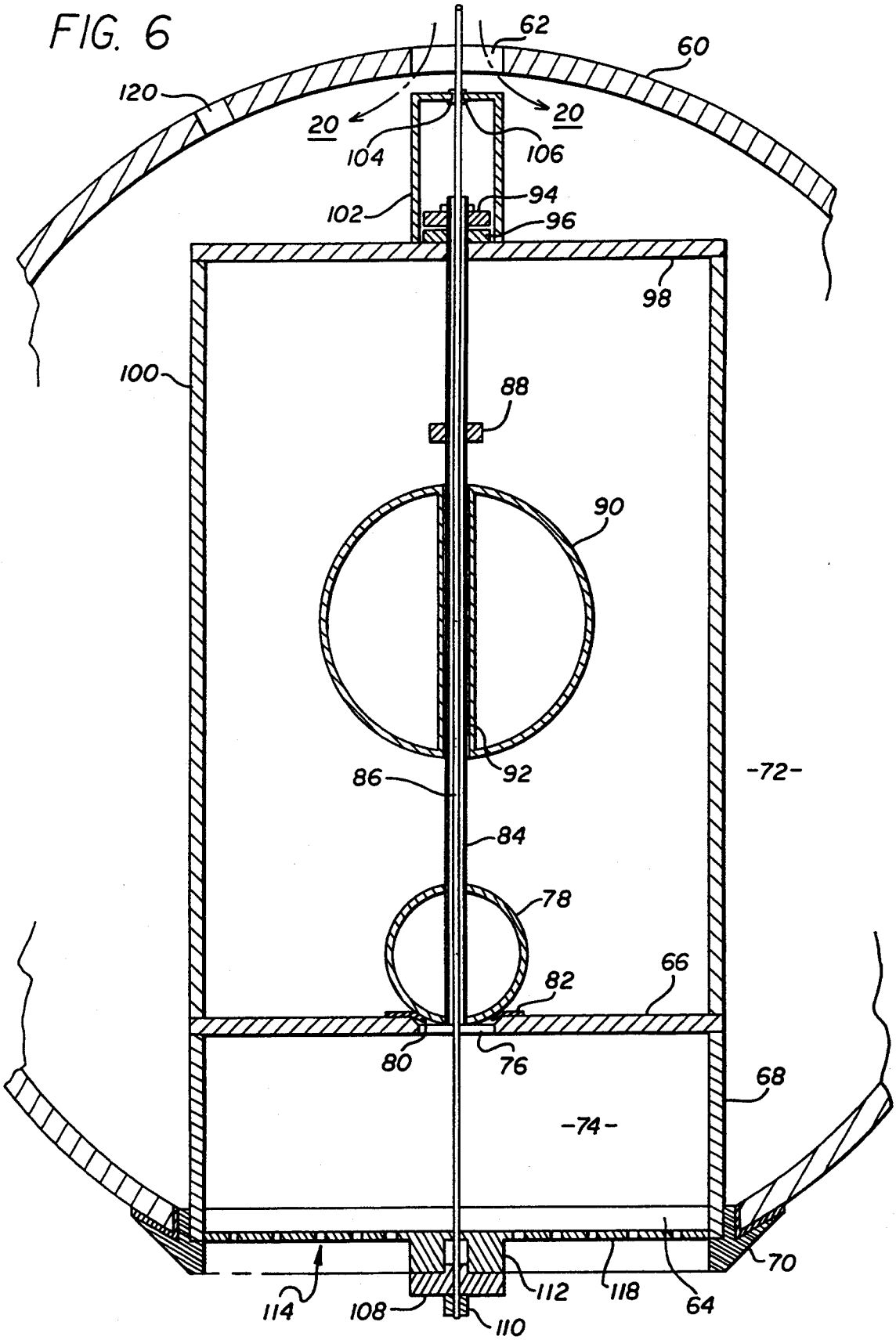
FIG. 6 is a side view of an alternate embodiment of the water display of FIG. 1, showing a first float seated into a container floor opening, a pair of magnets to keep the first float seated and a second float capable of sliding along a tube attached to the first float and magnets.

FIG. 6 shows an alternate embodiment of the liquid display of FIG. 1. This embodiment has a container 60 with top 62 and bottom 64 openings to allow a fluid 20 to flow into and out of the container 60. The container has a floor 66 elevated and supported by a first wall 68 that rest against a collar 70 inserted into the bottom opening 64 of the container 60. The floor 66 and first wall 68 define an inner cavity 72 within the container 60. The first wall 65 extends around 360 degrees to enclose a first chamber 74, wherein the wall 68 and floor 66 prevent fluid communication between the inner cavity 72 and the chamber 74 except through a opening 76 in the floor 66. Seated within the floor opening 76 is a first float 78 that prevents fluid 20 from flowing out of the container 60. The floor opening 76 may have a counterbore 80 to increase the surface contact between the float 78 and floor 66. The floor 66 may also have a gasket 82 to further seal the floor opening 76, when the first float 78 is seated therein. The first float 78 is securely attached to a tube 84 that extends through the inner cavity 72 along a vertical axis. The tube 84 encloses a rod 86, such that the tube 84 can move relative to the rod 86 along the vertical axis. Also attached to the tube 84 is a float collar 88 adapted to engage a second float 90 with a bore 92 that allows the float 90 to move relative to the tube 84. Although a collar 88 is shown, it is understood that the display can be constructed without the collar 88, wherein the second float 90 is attached to the tube 84. Fixed to one end of the tube 84 is a first magnet 94 that is attracted by a magnetic force to a second magnet 96. The second magnet 96 is mounted on top of ceiling 98 supported by two walls 100 that extend from the floor 66. Above the ceiling 98 is a housing 102 to guide the first magnet 94 as it extends up into the housing 102. The housing 102 being constructed to prevent fluid 20 from coming in contact with the magnets. The housing 102 has an opening 104 and an O-ring 106 that holds one end of the rod 86 in the housing 102. The rod 86 extends out of the container 60 so that the display can be suspended from a structure such as a ceiling. The other end of the rod 86 is connected to the collar 70 by a grommet 108 and a stop sleeve 110. The grommet 108 is attached to flange 112 that extends from the collar 70 into the center of the collar opening 114. The rod 86 thus being firmly mounted within the container 60. A screen 116 with a plurality of openings 118 can be attached to the collar 70 to diffuse the fluid 20 as it flows from the floor opening 76.

Figure 7:
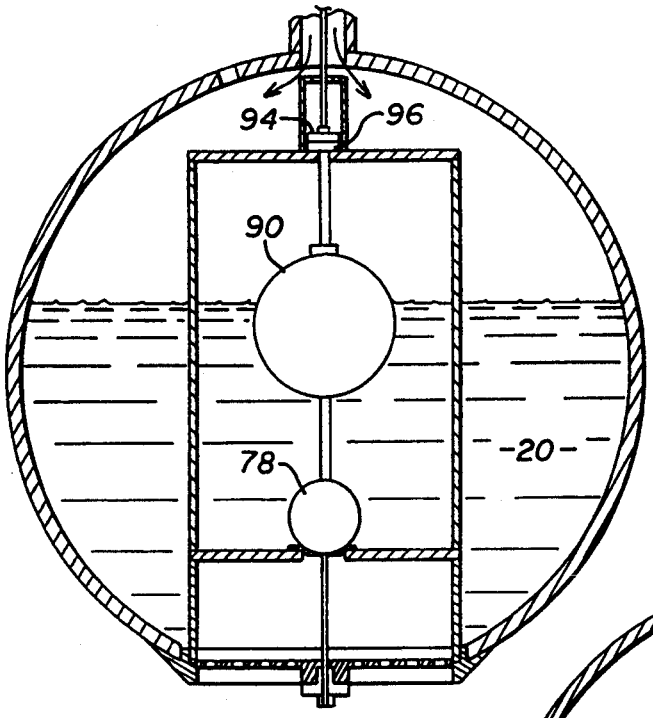
FIG. 7 is a side view of the water display of FIG. 6, showing water entering and filling the container and moving the second float until it comes in contact with a float collar attached to the tube.
Figure 8:
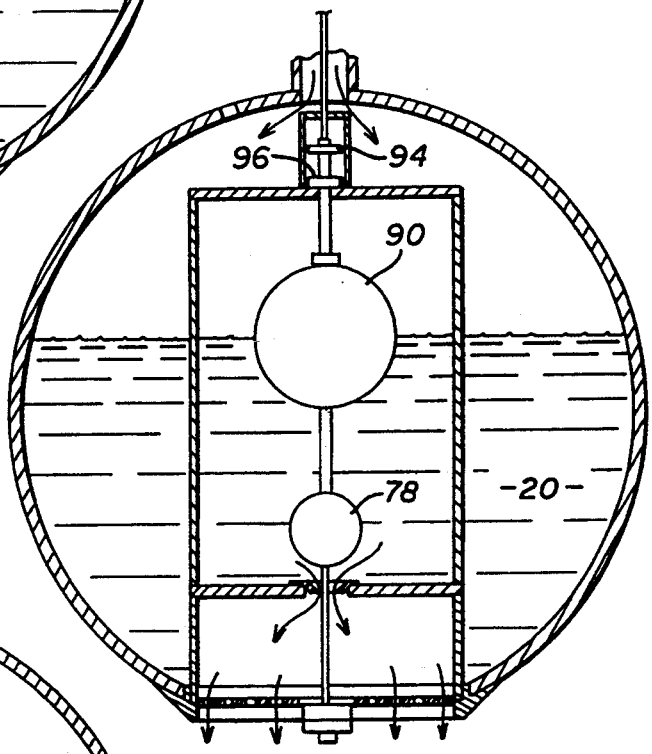
FIG. 8 is a side view of the water display of FIG. 6, showing the magnets separated by the buoyancy force of the second float, wherein the first float is unseated from the container opening allowing the fluid to flow out of the container.
Figure 9:
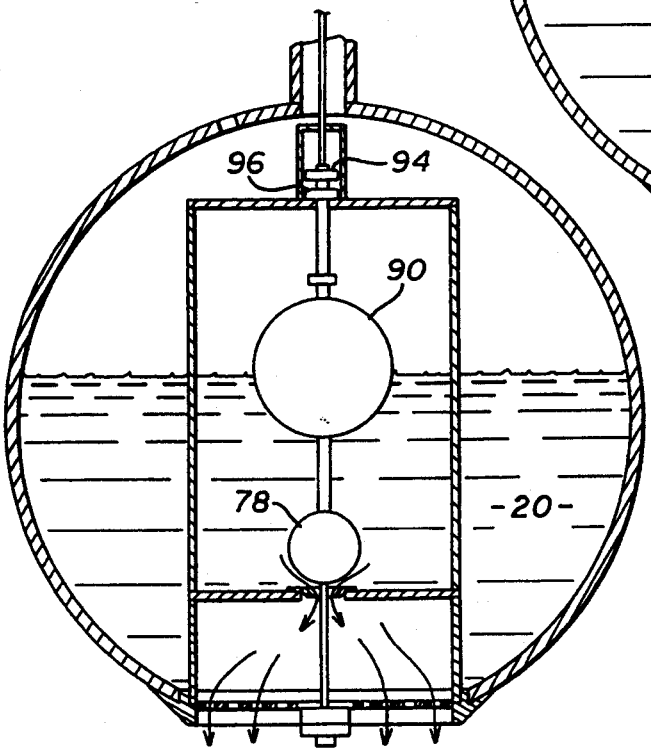
FIG. 9 is a side view of the water display of FIG. 6, showing the second float detached from the float collar and the magnets about to be drawn together, such that the first float is seated into the container opening to prevent fluid from flowing out of the container.

FIGS. 7–9 show the operation of the liquid display, wherein fluid 20 enters the container 60 and accumulates in the inner cavity 72. The fluid level rises causing the second float 90 to move up and come into contact with the float collar 88 as shown in FIG. 7. The magnetic force of the magnets prevent the collar 88 and second float 90 from moving, until the fluid 20 reaches a level such that the combined buoyancy force of the first 78 and second floats 90 is greater than the magnetic force attracting the magnets, wherein the magnets are separated and the tube 84 and floats are allowed to move up as shown in FIG. 8. The first float 78 is unseated from the floor opening 76 allowing the fluid 20 to flow out of the inner cavity 72 and through the screen 116. The floor opening 76 is of such dimension that the flowrate out of the inner cavity 72 is greater than the flowrate into the container 60. The fluid level decreases in the cavity 72, until the first float 78 falls to a level so that the magnets are attracted to each other, wherein the first float 78 is again seated into the floor opening 76. At this point the second float 90 has disengaged from the float collar 88, because the fluid level is below the collar 88 a distance greater than the diameter of the second float 90. The inner cavity 72 is again filled with fluid 20 and the cycle is repeated. The collar 88 can be constructed so that the collar 88 can be attached at various points along the tube 84. This allows the frequency of the display cycle to be varied. The container 60 of this embodiment also has a vent 120 to equalize the pressure in the inner cavity 72.

Although two floats are shown and described it is to be understood that the display can function with just the first float 78, wherein the buoyancy force of the first float 78 can separate the magnets. In this embodiment the area of the first float 78 can be increased to increase the buoyancy force on the float 78. In the preferred embodiment the floats are hollow members filled with air or another gaseous medium lighter than the fluid 20.

While certain exemplary embodiments have been described in detail and shown in the accompanying drawings it is to be understood that such embodiments are merely illustrative of, and not restrictive on the broad invention and that this invention should not be limited to the specific constructions and arrangements shown and described, since various other modifications may occur to those ordinarily skilled in the art.

What is claimed is:

1. A liquid ornamental display, comprising:

a container that is suspended from a Structure and has a floor that defines an inner cavity, said container having a top opening adapted to allow a fluid to flow into said inner cavity at a first predetermined flowrate, said floor being constructed to contain said fluid when said fluid flows into said inner cavity such that said fluid reaches a first predetermined level from said floor, said floor further having a floor opening adapted to allow said fluid to flow out of said inner cavity;

valve means operatively connected to said floor opening for allowing said fluid to flow out of said inner cavity at a second predetermined flowrate when said fluid reaches said first predetermined level, said second flowrate being greater than said first flowrate such that when said valve means allows said fluid to flow out of said inner cavity said fluid level in said inner cavity decreases, said valve means being constructed to allow fluid flow out of said inner cavity until said fluid level reaches a second predetermined level, wherein said fluid no longer flows out of said container and said fluid level in said inner cavity increases; and, a pool located below said suspended container to collect the fluid.

2. The liquid ornamental display as recited in claim 1, further comprising fluid means for providing a continuous flow of said fluid through said container top opening into said inner cavity at said first flowrate.

3. The liquid ornamental display as recited in claim 1, wherein said fluid is water.

4. The liquid ornamental display as recited in claim 3, wherein said container is transparent.

5. The liquid ornamental display as recited in claim 4, wherein said water has a predetermined color.

6. The liquid ornamental display as recited in claim 4, wherein said container has a spherical shape.

7. The liquid ornamental display as recited in claim 1, wherein said container has a vent adapted to allow air to flow into said inner cavity such that the air pressure within said inner cavity is approximately equal to the air pressure outside said inner cavity.

8. The liquid ornamental display as recited in claim 1, wherein said container has a screen located below said floor opening, said screen being constructed to collect and collimate said fluid such that said fluid flows out of said container in a predetermined arrangement of fluid streams.

9. The liquid ornamental display as recited in claim 1, wherein said valve means is a siphon tube having a first opening in said floor adapted to allow said fluid to flow out of said container at said second flowrate, a second opening within said inner cavity adapted to allow said fluid to flow from said inner cavity into said siphon tube, said siphon tube having a portion located a predetermined distance from said floor approximately equal to said first predetermined fluid level, whereby when said fluid enters said inner cavity and reaches said first predetermined level said fluid flows through said siphon tube and out said first opening, said fluid level decreases until said fluid level reaches said second predetermined level which is no greater than the distance between said floor and said second opening of said second tube.

10. The liquid ornamental display as recited in claim 1, wherein said valve means has a first float adapted to close said floor opening when said first float is in a closed position, and to allow said fluid to flow through said floor opening at said second flowrate when said first float floats into an open position when said fluid level reaches said first predetermined level, said first float having a first buoyancy force when said fluid level reaches said first predetermined level, said valve means having means that bias said first float into said closed position with a predetermined force less than said first buoyancy force, whereby said buoyancy force overcomes said bias of said means and allows said first float to float into said open position when said fluid level rises to said first predetermined level, wherein said fluid flows through said floor opening until said first float floats back into said closed position.

11. The liquid ornamental display as recited in claim 10, wherein said biasing means is a pair of magnets having a first magnet spaced by means a predetermined distance from said floor and a second magnet operatively connected to said first float adjacent said first magnet, said magnets having a predetermined attractive magnetic force that biases said first float into said closed position, said magnetic force being less than said first buoyancy force of said first float when said fluid level is at said first predetermined level such that said first buoyancy force separates said magnet.

12. The liquid ornamental display of claim 11, wherein said valve means further has a second float spaced from and operatively attached to said first float, such that the combined second buoyancy force of said first and second floats when said fluid level reaches said first predetermined level is greater than said magnetic force.

13. A liquid ornamental display, comprising:

a container that is suspended from a structure and has a floor that defines an inner cavity, said container having a top opening adapted to allow a fluid to flow into said inner cavity at a first predetermined flowrate, said floor being constructed to contain said fluid when said fluid flows into said inner cavity such that said fluid reaches a first predetermined level from said floor;

a first tube attached to said floor having a first opening in said floor adapted to allow said fluid to flow out of said container at a second predetermined flowrate greater than said first predetermined flowrate, and a second opening located within said inner cavity a predetermined distance from said floor approximately equal to said first predetermined fluid level;

a housing constructed to essentially enclose said first tube and spaced from said first tube such that said first tube and housing define a passage, said passage has a third opening located a predetermined distance from said floor, wherein said third opening and said passage allow fluid communication between said inner cavity and said second opening of said first tube;

a pool located below said suspended container to collect the fluid;

whereby when said fluid enters said inner cavity and rises to said first predetermined level said fluid flows into said second opening, through said first tube and out of said container through said first opening at said second flowrate which is greater than said first flowrate of said fluid entering said inner cavity, said fluid level decreases until said fluid level reaches a second predetermined level from said floor which is no greater than the distance between said floor and said third opening of said second tube.

14. The liquid ornamental display as recited in claim 13, further comprising fluid means for providing a continuous flow of said fluid through said container top opening into said inner cavity at said first flowrate.

15. The liquid ornamental display as recited in claim 13, wherein said fluid is water.

16. The liquid ornamental display as recited in claim 15, wherein said container is transparent.

17. The liquid ornamental display as recited in claim 16, wherein said water has a predetermined color.

18. The liquid ornamental display as recited in claim 16, wherein said container has a spherical shape.

19. The liquid ornamental display as recited in claim 13, wherein said container has a vent adapted to allow air to flow into said inner cavity such that the air pressure within said inner cavity is approximately equal to the air pressure outside said inner cavity.

20. The liquid ornamental display as recited in claim 13, wherein said container has a screen located below said floor opening, said screen being constructed to collect and collimate said fluid such that said fluid flows out of said container in a predetermined arrangement of fluid streams.

21. A liquid ornamental display, comprising:

a container having a floor that defines an inner cavity, said container having a top opening adapted to allow a fluid to flow into said inner cavity at a first flowrate, said floor being constructed to contain said fluid when said fluid flows into said inner cavity such that said fluid reaches a first predetermined level from said floor, said floor further having a floor opening adapted to allow said fluid to flow out of said inner cavity;

a first float within said inner cavity adapted to prevent said fluid from flowing through said floor opening when said first float is in a closed position and to allow said fluid to flow through said floor opening at a second flowrate greater than said first flowrate when said first float is in an open position, said first float is adapted to float into said open position when said fluid level reaches said first predetermined level, said first float having a first buoyancy force when said fluid level reaches said first predetermined level;

a tube attached at one end to said first float;

guide means operatively connected to said tube such that said tube extends in an essentially vertical position; and, a pair of magnets having a first magnet spaced by support means a predetermined distance from said floor and a second magnet attached to an opposite end of said tube adjacent said first magnet, said magnets having a predetermined attractive magnetic force that biases said first float into said closed position, said magnetic force being less than said first buoyancy force of said first float when said fluid level reaches said first predetermined level such that said buoyancy force separates said magnet;

whereby when said fluid flows into said inner cavity and said fluid level reaches said first predetermined level, said first buoyancy force separates said magnets and said first float is allowed to float into said open position such that said fluid flows through said floor opening at said second flowrate until said first float reaches a level approximately at said closed position, wherein said pair of magnets biases said first float into said closed position.

22. The liquid ornamental display as recited in claim 21, further comprising a second float attached to said tube at a predetermined distance from said first float, said first and second floats having a combined second buoyancy force when said fluid level reaches said first predetermined level, greater than said magnetic force of said pair of magnets.

23. The liquid ornamental display as recited in claim 22, further comprising a float collar attached to said tube a predetermined distance from said floor, said second float being constructed to move relative to said tube along a vertical axis such that said second float abuts said float collar when said fluid level reaches a second predetermined level less than said first predetermined level.

24. The liquid ornamental display as recited in claim 22, wherein said floats are constructed as hollow spheres.

25. The liquid ornamental display as recited in claim 21, wherein said guide means is a rod that extends from said top of said container to at least said container floor.

26. The liquid ornamental display as recited in claim 21, wherein said support means includes a pair of walls extending from said floor in a vertical direction that supports a ceiling, said ceiling supports and separates said first magnet from said floor.

27. The liquid ornamental display as recited in claim 21, further comprising fluid means for providing a continuous flow of said fluid through said container top opening into said inner cavity at said first flowrate.

28. The liquid ornamental display as recited in claim 21, wherein said fluid is water.

29. The liquid ornamental display as recited in claim 28, wherein said container is transparent.

30. The liquid ornamental display as recited in claim 29, wherein said water has a predetermined color.

31. The liquid ornamental display as recited in claim 29, wherein said container has a spherical shape.

32. The liquid ornamental display as recited in claim 21, wherein said container has a vent adapted to allow air to flow into said inner cavity such that the air pressure within said inner cavity is approximately equal to the air pressure outside said inner cavity.

33. The liquid ornamental display as recited in claim 21, wherein said container has a screen located below said floor opening, said screen being constructed to collect and collimate said fluid such that said fluid flows out of said container in a predetermined arrangement of fluid streams.

34. The liquid ornamental display as recited in claim 21, wherein said container is suspended by means from a structure.

35. The liquid ornamental display as recited in claim 34, further comprising a pool located below said suspended container, wherein said pool collects said fluid.

* * * * *